US006422405B1

(12) United States Patent
Haenszel

(10) Patent No.: US 6,422,405 B1
(45) **Date of Patent: *Jul. 23, 2002**

(54) ADJUSTABLE DUNNAGE RACK

(75) Inventor: James D. Haenszel, Columbus, OH (US)

(73) Assignee: Accurate Fabrication, Inc., Columbus, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/635,148

(22) Filed: Aug. 8, 2000

Related U.S. Application Data

(63) Continuation of application No. 09/082,330, filed on May 21, 1998, now Pat. No. 6,123,208.

(51) Int. Cl.[7] ..... A47F 5/00; A47B 47/00; B65D 19/44

(52) U.S. Cl. ..... 211/175; 211/208; 108/55.1

(58) Field of Search ..... 211/175, 183, 211/189, 194, 195, 208, 85.8; 108/55.1, 56.1

(56) References Cited

U.S. PATENT DOCUMENTS 4,714,169 A * 12/1987 Keenan et al. ..... 220/8
4,819,816 A * 4/1989 Noble, Sr. ..... 211/189
6,109,462 A * 8/2000 Emalfarb et al. ..... 211/119
6,123,208 A * 9/2000 Haenszel ..... 211/175

* cited by examiner

*Primary Examiner*—Daniel P. Stodola
*Assistant Examiner*—Erica B. Harris
(74) *Attorney, Agent, or Firm*—Standley & Gilcrest LLP

(57) ABSTRACT

A vertically and or horizontally adjustable and reconfigurable dunnage rack capable of accommodating new dunnage sizes and shapes associated with annual model year changes, which preferably includes, among other elements, a base and a pair of upstanding adjustably spaced apart walls detachably connected to the base, wherein each wall includes a dunnage support assembly attached to inner surfaces and a fastening assembly for releasably securing the walls to the base after adjustment.

13 Claims, 8 Drawing Sheets

ADJUSTABLE DUNNAGE RACK

This Application is a continuation of application Ser. No. 09/082,330, filed on May 21, 1998, now U.S. Pat. No. 6,123,208.

BACKGROUND OF THE INVENTION

1. Field of the Invention

The present invention relates generally to assembly line dunnage racks, and more particularly to a configurable and adjustable apparatus for transporting vehicle parts and assemblies from a part or sub-assembly supplier to an intermediate or final vehicle factory assembly line without damage to the parts during shipment.

2. Background

The assembly line manufacturing system employed for the production of personal, recreational and commercial vehicles, requires the continuous delivery of large quantities of undamaged parts and sub-assemblies from suppliers to the factory worker on the assembly line. For convenience and efficiency, large, generally rectangular box-shaped racks have been developed which are customized to carry a plurality of finished parts or subassemblies, for example, vehicle doors, tires, wire harnesses, dashboards, drive train components and the like, from the supplier to an assembly line worker responsible for installing the particular part on the vehicle. A single rack is typically loaded with a plurality of identical parts and is usually delivered right to an individual worker at the proper location on the factory assembly line. The parts are restrained in the racks during transit with various types of support hardware such as protective foam inserts and associated hardware commonly referred to as dunnage. Despite the long use and wide spread acceptance of many types of customized dunnage racks, many shortcomings persist and there is an absence from the art of many desirable characteristics and needed capabilities.

One type of a generally box-like dunnage rack known to the art is customized for shipment of a plurality of a particular part or sub-assembly from a supplier to a factory assembly line. Such a rack is capable of protecting parts during shipment and incorporates expensive and complicated locking mechanisms for securing and protecting the parts. However, this rack cannot be cost effectively reconfigured for use with different types of dunnage and parts. This kind of rack is especially incapable of accommodating the annually changing dimensions and configurations of redesigned parts and sub-assemblies associated with model year vehicle changes. Accordingly, this type of rack is usually scrapped, causing significant material waste, after only being used for shipments of a single model year part. Thus, manufacturers and suppliers typically must incur considerable annual costs to design, test and fabricate new dunnage racks which are compatible for use with the parts and sub-assemblies associated with the new model year vehicles. Because of the high-demand created for new dunnage racks every year, long-lead times are usually associated with such fabrication efforts.

What is needed is a cost effective apparatus for efficiently transporting parts to a factory assembly line without damage and which can be fabricated with reduced costs, waste and minimized lead-time. The apparatus and hardware involved should be simple and straightforward, and little effort should be required on the part of the dunnage rack manufacturer, parts supplier or vehicle manufacturer to recondition, reconfigure and reuse the dunnage rack. Ideally, the dunnage rack should incorporate a system capable of use with various vehicle parts and sub-assemblies across successive vehicle model years which will eliminate the need for fabrication of customized racks for the majority of part shipping requirements.

SUMMARY OF THE INVENTION

The present invention provides an apparatus for shipping parts without damage during transit which minimizes costs, material waste and lead-time for fabrication and reconfiguration for reuse with different parts for the same and successive vehicle model years. The invention provides a dunnage rack which is easily transported from a supplier to a factory assembly line worker and which is easily both refitted with replacement dunnage and adjustable, for example, in height and length such that the rack is quickly and cost-effectively reconfigurable. Similarly, the present invention also provides a dunnage rack system which is modular in design so as to accommodate a nearly unlimited range of part and sub-assembly dimensions and configurations without the need for the customized design and fabrication of a unique rack for every type of part for each successive vehicle model year.

The present invention preferably includes an adjustable, reusable, reconfigurable and durable dunnage rack which includes a base, a pair of upstanding adjustably spaced apart opposite front and rear walls detachably connected to the base. Each wall includes a dunnage support assembly attached to respective inner surfaces and a fastening assembly for releasably securing the walls to the base after adjustment, and an upright side wall connected to the base and the walls and extending between the front and rear walls and also including a dunnage support assembly attached to an inside racing surface.

The invention also preferably includes a transportation assembly having a plurality of wheels and forklift receptacles attached on the underside of the base, a pivotable forward projecting trailer tongue with a hitch ring and connected to the front end of the base or the exterior of the wall and a hitch assembly formed on the rear end of the base or the exterior of the rear wall. The respective front and rear walls are each also formed with a plurality of vertical posts disposed at opposite respective edges and with each post having an upwardly projecting rack stacking pin at its upper extremity and a downwardly facing stacking receptacle at its lower extremity. A plurality of fastening assemblies releasably secures the front and rear walls to the respective ends of the base. At least one upright side wall, formed with a length approximately equal to a predetermined distance between the front and rear walls, is secured at its lower edge to the base and extends between and is detachably connected at its opposite ends to the front and rear walls.

Other features and advantages of the invention will become apparent from the following detailed description, taken in conjunction with the accompanying drawings, which illustrate, by way of example, the features of the present invention.

BRIEF DESCRIPTION OF THE DRAWINGS

Referring now to the drawings, wherein like reference numerals, such as those numerals with primes or double primes, across the several views refer to identical, corresponding or equivalent parts, and wherein.

DETAILED DESCRIPTION OF THE PREFERRED EMBODIMENT(S)

Manufacturers of various types of vehicles and vehicle parts and sub-assemblies presently encounter otherwise avoidable costs, unnecessary material waste and inordinately long lead time associated with the design, development and fabrication of the dunnage racks needed for the safe shipment of parts and sub-assemblies from suppliers to factory assembly lines. Presently, after vehicle manufacturers annually introduce the new model year vehicles, new dunnage racks and dunnage support assemblies must be fabricated to facilitate the different part and sub-assembly dimensions and configurations of the new model year vehicles. Accordingly, the dunnage racks and support assemblies for the previous model year parts and sub-assemblies are no longer serviceable and must be scrapped. The adjustable and reusable parts transportation rack embodying the present invention provides a new and cost effective means for reducing such costs, waste and lead times. Such improvements to the art are accomplished with the present invention which is an adjustable and reconfigurable dunnage rack capable of accommodating the new part dimensions and configurations associated with the annual model year changes.

Figure 1:
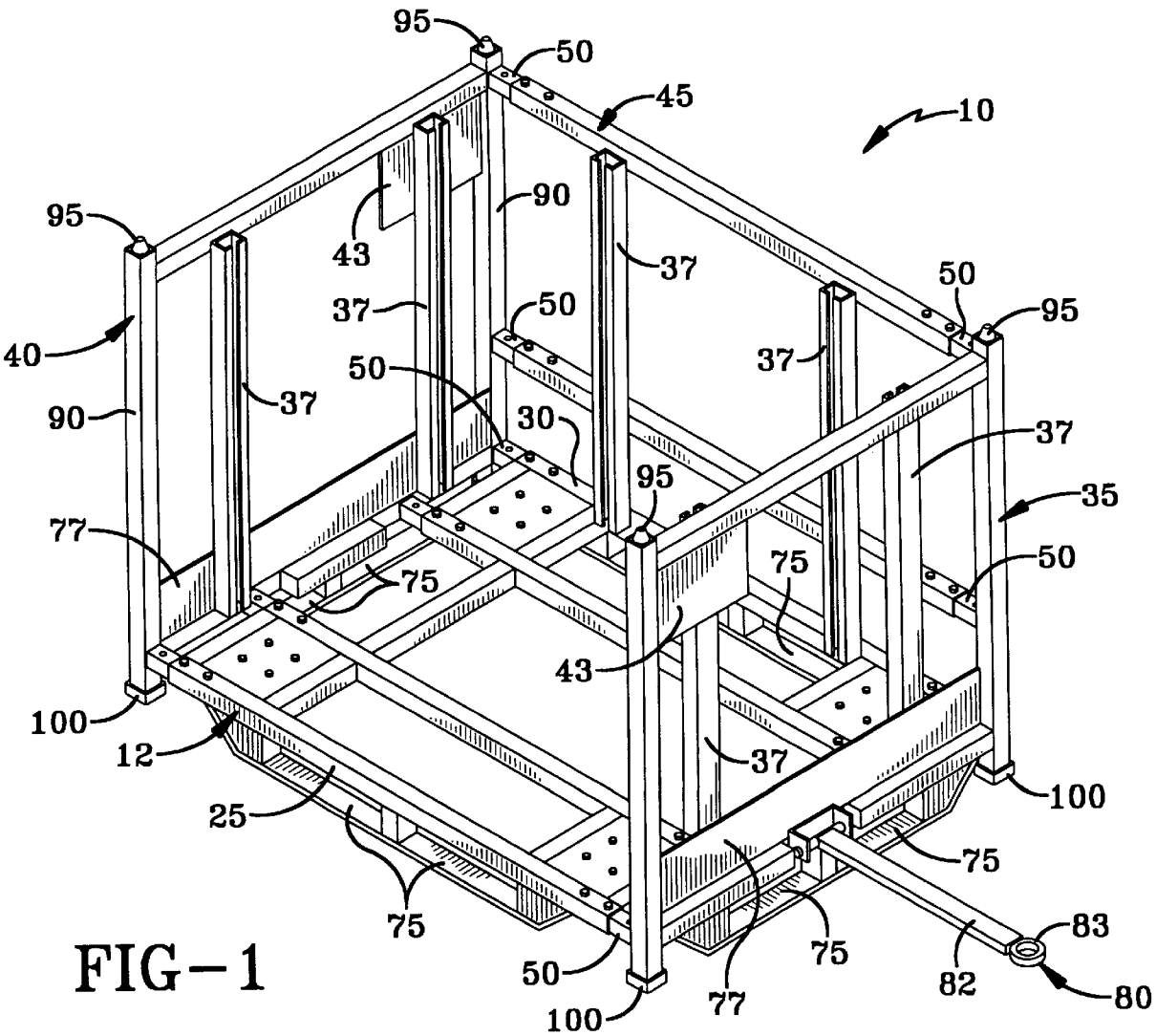
FIG. 1 depicts an elevated perspective view, in reduced scale, of an adjustable dunnage rack of a preferred embodiment of the present invention.
Figure 2:
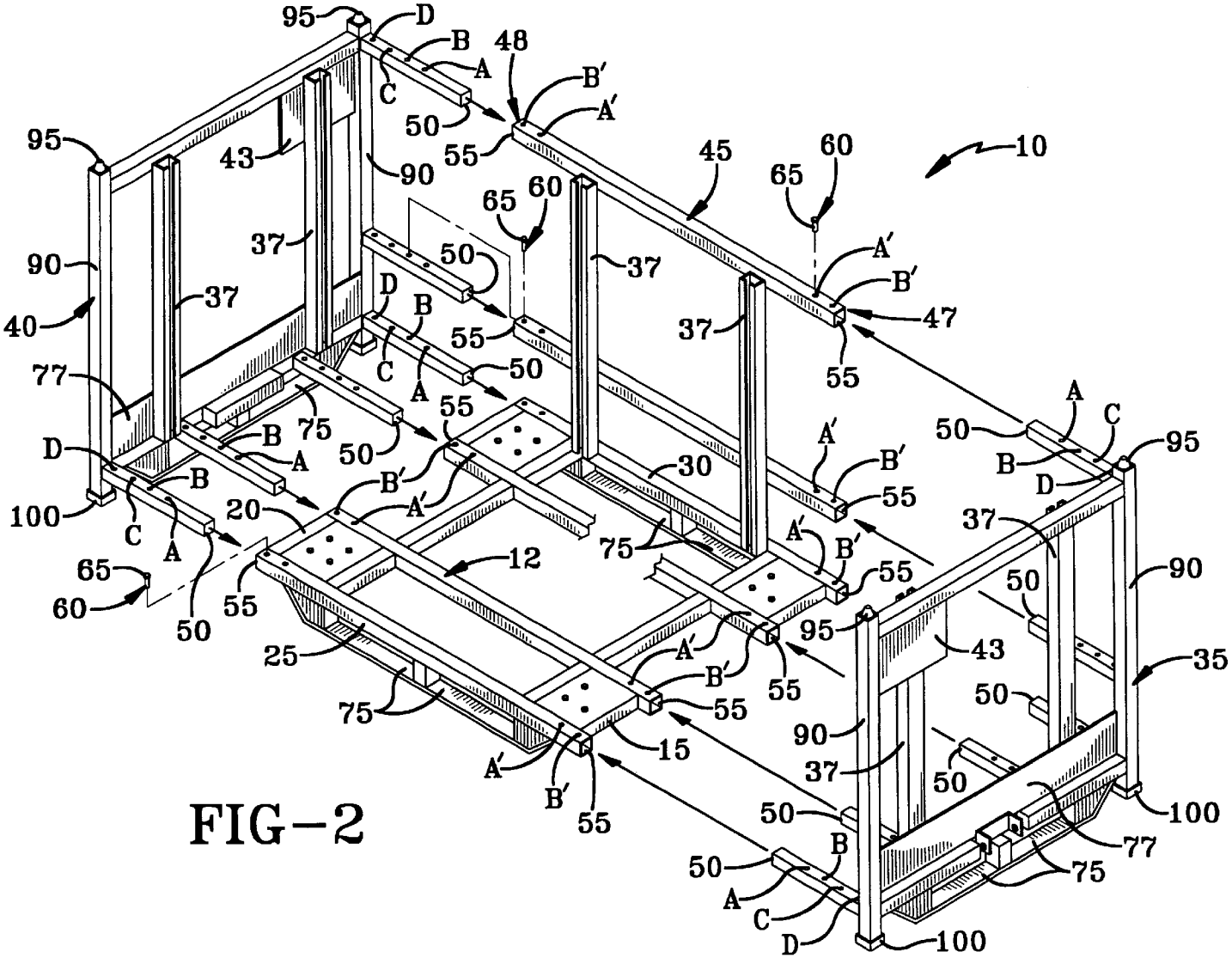
FIG. 2 depicts an exploded perspective view, in reduced scale, of the rack of FIG. 1.

As can be understood with reference to FIGS. 1 and 2, the present invention is an adjustable dunnage rack designated generally by reference numeral 10. One of the preferred embodiments of rack 10 includes a generally rectangular horizontal base 12 which is formed with opposite front 15 and rear ends 20, and a loading side 25 opposite a support wall side 30. A front wall 35 and a rear wall 40 are detachably and adjustably connected, respectively, to the front and rear ends 15, 20 and each have a constant width approximately equal to the lateral width of the base 12. An upright side support wall 45 is detachably or fixedly secured at its lower edge to the support wall side 30 of base 12 and extends between the front and rear walls 35, 40. In variations of the preferred embodiment, side support wall 45 is positioned between front and rear walls 35, 40 about a longitudinal centerline from the front 15 to the rear end 20 across the longitudinal length of the base 12. Depending upon the part orientation and configuration, the side support wall 45 preferably has a vertical orientation and is connected at its opposite edges 47 and 48 to the corresponding front and rear walls 35, 40, respectively. The front, rear and side support walls 35, 40, 45, respectively, also include dunnage support assemblies 37, as discussed in more detail below. The rack 10 also includes a plurality of label identification plates 43 which are preferably located on the front and rear walls 35, 40 although any easily visible location is suitable.

Front and rear walls 35, 40 are each formed with a plurality of extension arms 50 each having a plurality of adjustment bores. The arms 50 depend orthogonally from the inner surface of the respective walls 35, 40 and project inwardly towards the base 12 when the walls 35, 40 are disposed in their positions adjacent to the front and rear ends 15, 20, respectively, of the base 12. Preferably, the extension arms 50 are formed from solid steel bars approximately eighteen inches long and one-and-three-quarters inches in diameter. For purposes of illustration only and not for limitation, adjustment bores, such as bores A, B, C, and D are shown in the various figures and are designated in FIG. 2. These bores A, B, C, and D are spaced preferably apart to have a consistent equal spacing between each bore. Base 12 and side wall 45 are formed with outwardly facing extension arm receptacles 55 which are each positioned and preferably formed to telescopically and adjustably receive an individual one of the extension arms 50. The receptacles 55 are also formed with adjustment openings or bores, for example, bores A', B' which are spaced apart to correspond with the spacing between extension arm bores A, B, C, and D. Rack 10 also includes a fastener or fastening assembly 60 which is shown in schematic representation in FIG. 2, for purposes of example, to be a bolt 65, such as a one-half inch hardened steel bolt. The fastening assembly 60 is intended to be used with any of a wide variety of well-known and compatible locking devices including, but not limited to, locking nuts and cotter-type pins. The fastening assembly 60, arms 50 and the receptacles 55 cooperate together to form an adjustment mechanism for adjusting the front and rear walls 35, 40 to the desired predetermined length or distance apart.

Figure 8:
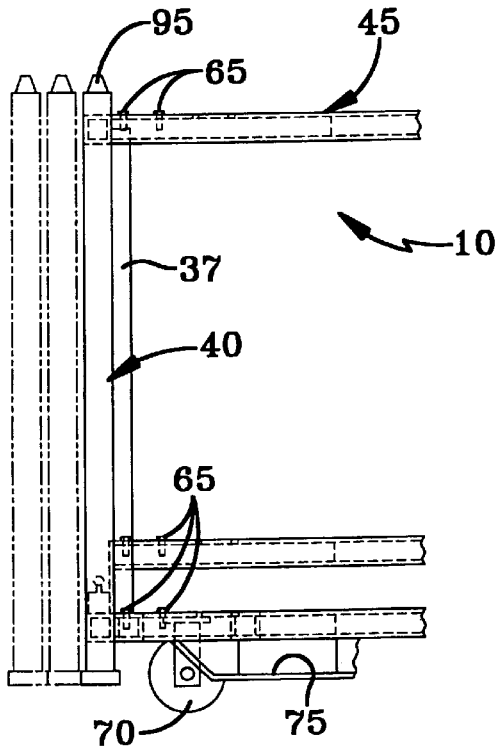
FIG. 8 is a partial side view, in reduced scale, of the rack of FIG. 1, wherein a wheel 70 not visible in the view of FIG. 1 can be seen.

The rack 10 is assembled with front and rear walls 35, 40 detachably connected to base 12 and side wall 45 with the extension receptacles 55 slidably and telescopically receiving extension arms 50. The front and rear walls 35, 40 are adjusted to a selected spaced apart predetermined distance such that extension receptacle bores A', B' are aligned to correspond with a contiguous pair of extension arm bores, for example, bore pairs A and B, B and C, or C and D. This exemplary configuration of bores creates a total nine possible combinations of positions of the front wall 35 and the rear wall 40 relative to the base 12 resulting in six possible spaced apart predetermined distances. Many possible configurations of the extension arms 50 and receptacles 55, having more or less bores and varied spacing between bores, are contemplated by the present invention to provide a wide range of adjustability of the length of the rack 10. See, for example, FIG. 8 where the multiple positions of rear wall 40 are depicted schematically. Preferably, the various bores, extension arms and extension receptacles described above are configured such that, when the front and rear walls 35, 40 are fully extended, approximately an additional six inches of extension is possible per wall. Thus, if both walls 35, 40 are fully extended, a total of twelve inches of length is added to the predetermined distance between the inside surfaces of the front and rear walls 35, 40. Typically, the individual bore and opening pairs are approximately three inches apart. This configuration creates compatibility of the rack 10 of the present invention for use with a limitless range of part configurations and eliminates the need for the customized design and fabrication of a dedicated dunnage rack suitable for use with only a single type of part produced for a particular model year vehicle.

The rack 10 also preferably incorporates an underside transportation assembly including a plurality of underside wheels 70 (see FIGS. 8 through 13) and forklift receptacles 75 (see FIGS. 1 through 12) to facilitate convenient and efficient shipment and maneuvering of the rack 10. The underside wheels 70 are preferably installed on the base 12 as far outboard as possible from the center of gravity of the rack 10 to maximize the lateral and longitudinal wheel base. The forklift receptacles 75 are formed in a lateral, width direction and in a longitudinal, length direction in the base 12 to permit the tines or forks of a forklift vehicle to conveniently engage the underside of the base 12 from all sides. Similar to the wheel configuration, the receptacles 75 on each side 15, 20, 25, 30 of base 12 are most preferably spaced as far apart as possible from the lateral and longitudinal centerlines of the base 12 so as to maximize stability during lifting and raised movement. The lower portion of front and rear walls 35, 40 include fork guards 77 to reduce the possibility of damage to part during forklift operations.

Figure 6:
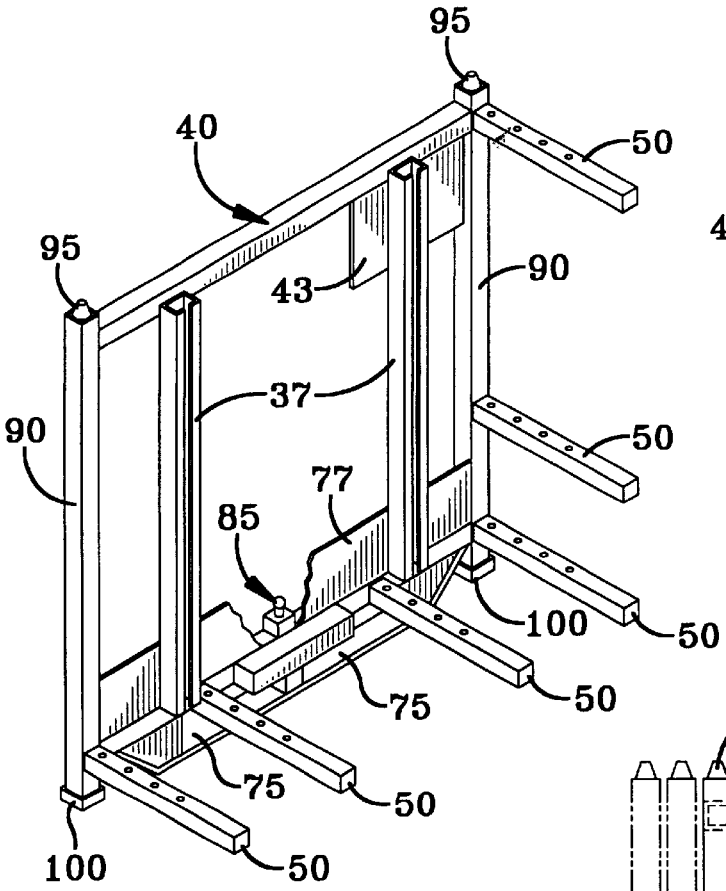
FIG. 6 is a partial perspective view, with certain parts removed for illustration purposes, of the rear wall of the rack shown in FIG. 2 and with a portion of the fork guard removed to show the hitch assembly.
Figure 7:
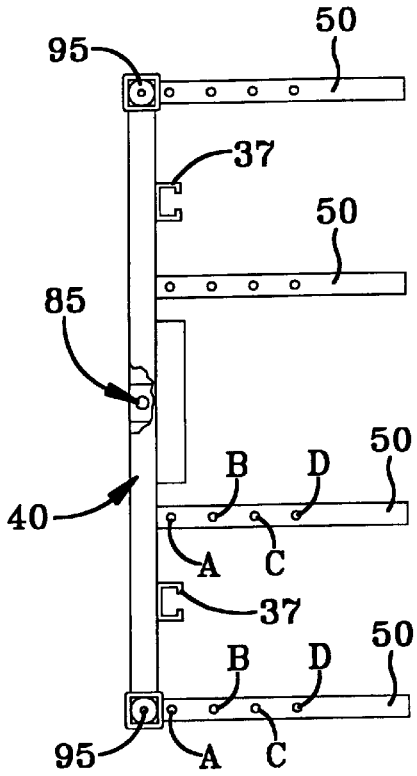
FIG. 7 is a rotated top, plan view, in enlarged scale, of the side wall of FIG. 5.

For purposes of facilitating efficient movement of one or multiple racks 10, such as in a tandem trailer configuration, the rack 10 also incorporates a multi-axis pivoting trailer tongue assembly 80 (see FIGS. 1 and 3) having a tongue 82 and hitch ring 83, and a hitch assembly 85 (see FIG. 6). The trailer tongue and hitch assemblies 80, 85 are preferably incorporated on the exterior side of front and rear walls 35, 40, respectively. In an additional variation of the preferred embodiment, the assemblies 80, 85 are attached to the front end 15 and rear end 20, respectively, of the base 12 and the walls 35, 40 are adapted with recesses, not shown, about their respective lower portions so the tongue and hitch assemblies 80, 85 may freely move about and remain unobstructed during operation.

With continued reference to FIGS. 1 and 2, each of the walls 35, 40 preferably include a plurality (not shown) or a pair (as shown) of vertical posts 90 which each incorporate a stacking pin 95 at a top end or upper extremity and a stacking receptacle 100 at a lower extremity or bottom end. The vertical posts are preferably fabricated from any of a number of readily available two inch by two inch, eleven gauge steel tube extrusions having the strength properties compatible for use with the anticipated parts. The receptacle 100 is configured to receive the pin 95 such that multiple racks 10 may be stacked one on top of another. This feature is particularly useful in transporting a plurality of racks 10 from a supplier to an assembly line factory within the most commonly available trailer trucks in use by most common carriers. To this end, the height of the rack 10 from the top of the pin 95 to the bottom-most point on the rack 10, which is typically the bottom of the wheel 70 where it meets the ground, is most preferably approximately 51 inches. At this height, two racks 10 may be stacked one upon another in a majority of the commonly available trailers mentioned above. To further facilitate shipment of the racks 10 with such carriers, the base 12 and the front and rear walls 35, 40 have a constant width which is most preferably approximately 47 inches in lateral width. This width allows the side-by-side positioning of two racks 10 in the same above-described trailers. These height and lateral width dimensions provide for the most efficient shipment of the racks 10 by common carriers. The preferred optimum longitudinal lengths of the base 10 have also been determined and are described in more detail below.

Figure 3:
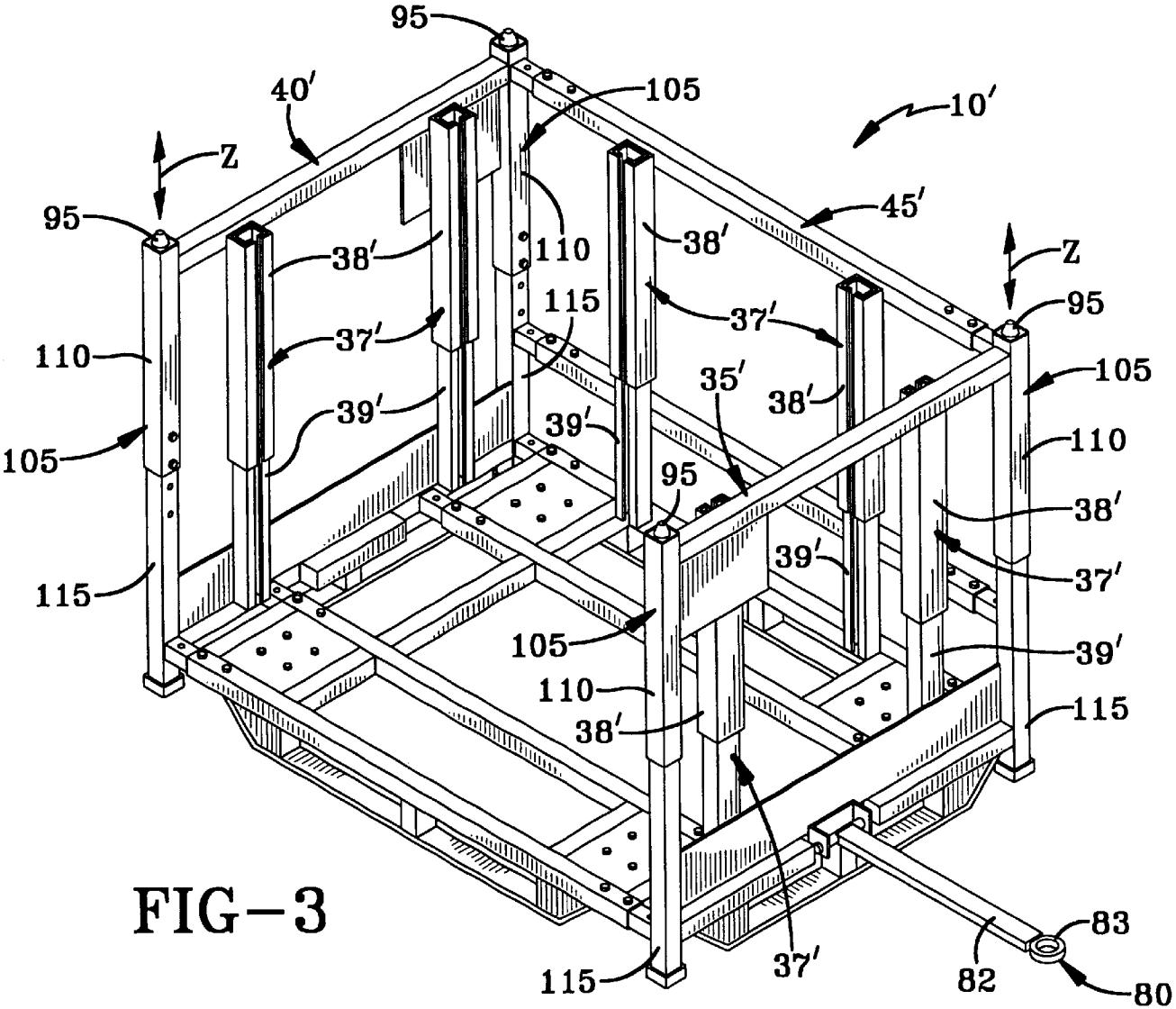
FIG. 3 is an elevated perspective view, also in reduced scale of a variation of the adjustable dunnage rack of FIG. 1.

Referring now to FIG. 3, a variation of the preferred embodiment of the present invention is depicted and generally designated by reference numeral 10'. This particular variation is contemplated for use either alone or in combination with any of the previously described embodiments. In the instant variation, a vertical height adjustment of the walls 35', 40', 45' is accomplished in the direction of arrows designated "Z" by incorporation of a telescopic vertical adjustment assembly referred in each of the respective vertical post of the walls. As can be understood in light of the preceding descriptions, heights in excess of approximately 51 inches may reduce the efficiency of shipment of the racks 10' as they may no longer be suitable for double stacking in the common carrier trailers most readily available. The front and rear walls 35' and 40', respectively, are each configured with a pair or plurality (pair shown) vertical posts 105 having an upper segment 110 adapted for slidably, adjustably and telescopically receiving a lower segment 115 to facilitate vertical adjustment of the rack 10 to the desired height. With this configuration, an even greater variety of parts may be accommodated with the rack 10' of the present invention without the need for fabrication of customized, unique dunnage racks. This is especially useful in accommodating the annual model year changes to the parts and sub-assemblies of vehicles.

Figure 4:
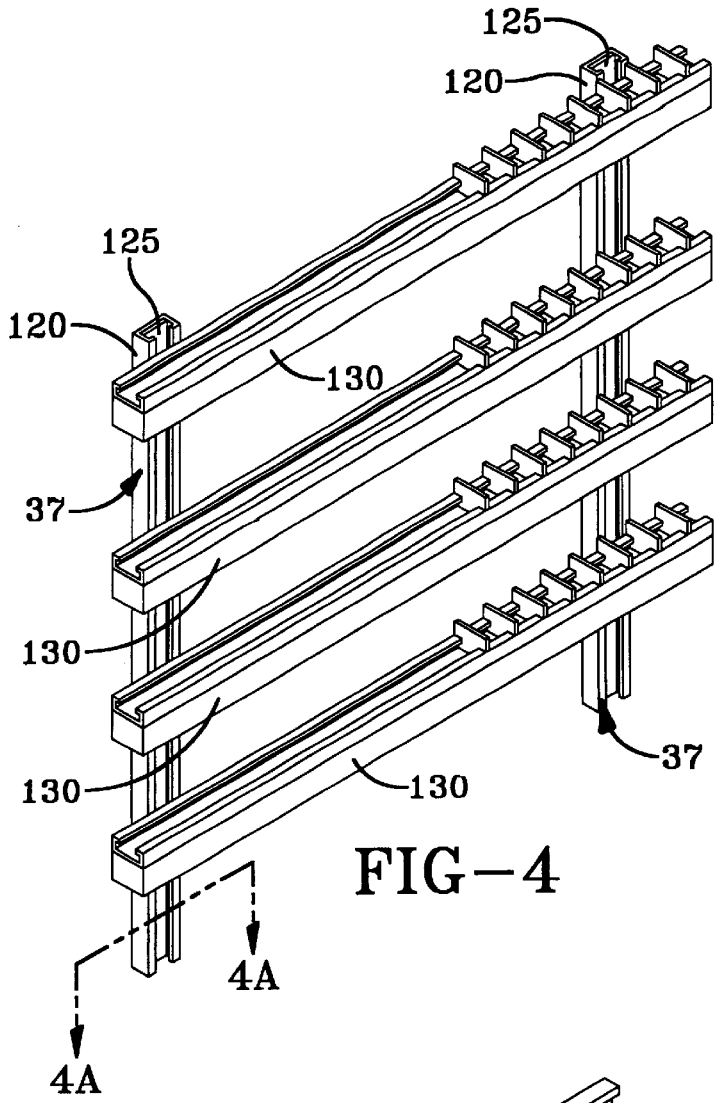
FIG. 4 is a partial perspective view, in enlarged scale and with certain structure removed for purposes of illustration, of the rack of FIG. 1 with dunnage support hardware installed into the dunnage support assemblies.
Figure 4A:
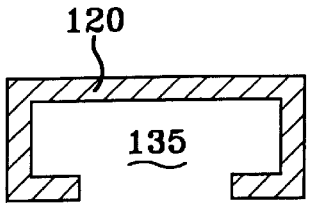
FIG. 4*a* is a rotated cross-section view, in enlarged scale, taken along line 4*a*—4*a* in FIG. 4 of the dunnage support assembly.
Figure 5:
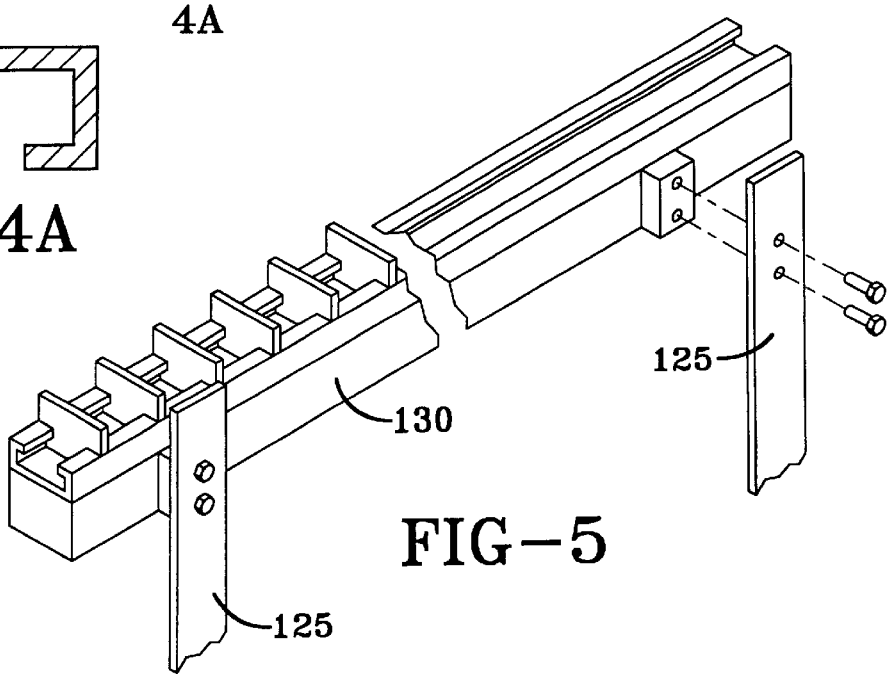
FIG. 5 is a partial perspective view, in enlarged scale and with certain structure removed for illustration purposes, of the rear side of the dunnage support hardware of FIG. 4.

Referring next to FIGS. 4 through 5, the rack 10 includes dunnage support assemblies 37 which are preferably a "C"-shaped channel extrusion 120 of steel or other suitable strength material. With a C-channel extrusion 120, various types of well-known dunnage support hardware may be installed with minimal design constraints, short lead time and very low cost. For example, and not for purposes of limitation, a pair of dunnage bars 125 may be bolted to various types of dunnage support hardware 130 wherein the dunnage bars 125 are spaced apart a distance corresponding to the spacing of the C-channel extrusions 120 of rack 10 such that bars 125 may be received within the respective keyways 135 of the extrusions 120. With this arrangement, dunnage support hardware 130 may be quickly removed and replaced to facilitate repairs or reconfigurations of the dunnage rack 10. Many types of extrusion shapes are readily available which are equally suitable for use with the dunnage support assemblies 37 of the present invention. Although only two such assemblies 37 are described here, a single support assembly 37 may be suitable for certain applications while three or more such support assemblies 37 may be required for other applications.

With reference again to FIG. 3, the rack 10' incorporates vertical adjustable dunnage rack assemblies 37'. The assemblies 37' have an upper portion 38' formed to telescopically receive a lower portion 39'. The upper and lower portions 38', 39' are preferably fixed to the respective wall structure so as to extend and retract as the respective walls 35', 40', 45' to which the assemblies are attached are adjusted to the desired vertical height. The assemblies 37' also preferably incorporate the C-channel configuration already described.

In this arrangement, the keyway of the C-channel extrusion will have different dimensions in the upper portion 38' relative to the lower portion 39'. Therefore, alternative dunnage support hardware, not shown, is fabricated to have upper and lower outer dimensions which correspond to the inner keyway dimensions of the C-channel extrusions of the upper and lower portions 38', 39'. In a simplified variation of this vertically adjustable rack 10', a non-adjustable or fixed-length C-channel, or other suitable cross-section, extrusion is used and is simply fabricated with the desired final length of the respective adjustable wall such that the dunnage support assemblies 37' will have a height equal to the final respective wall height when the assemblies 37' are installed.

Figure 9:
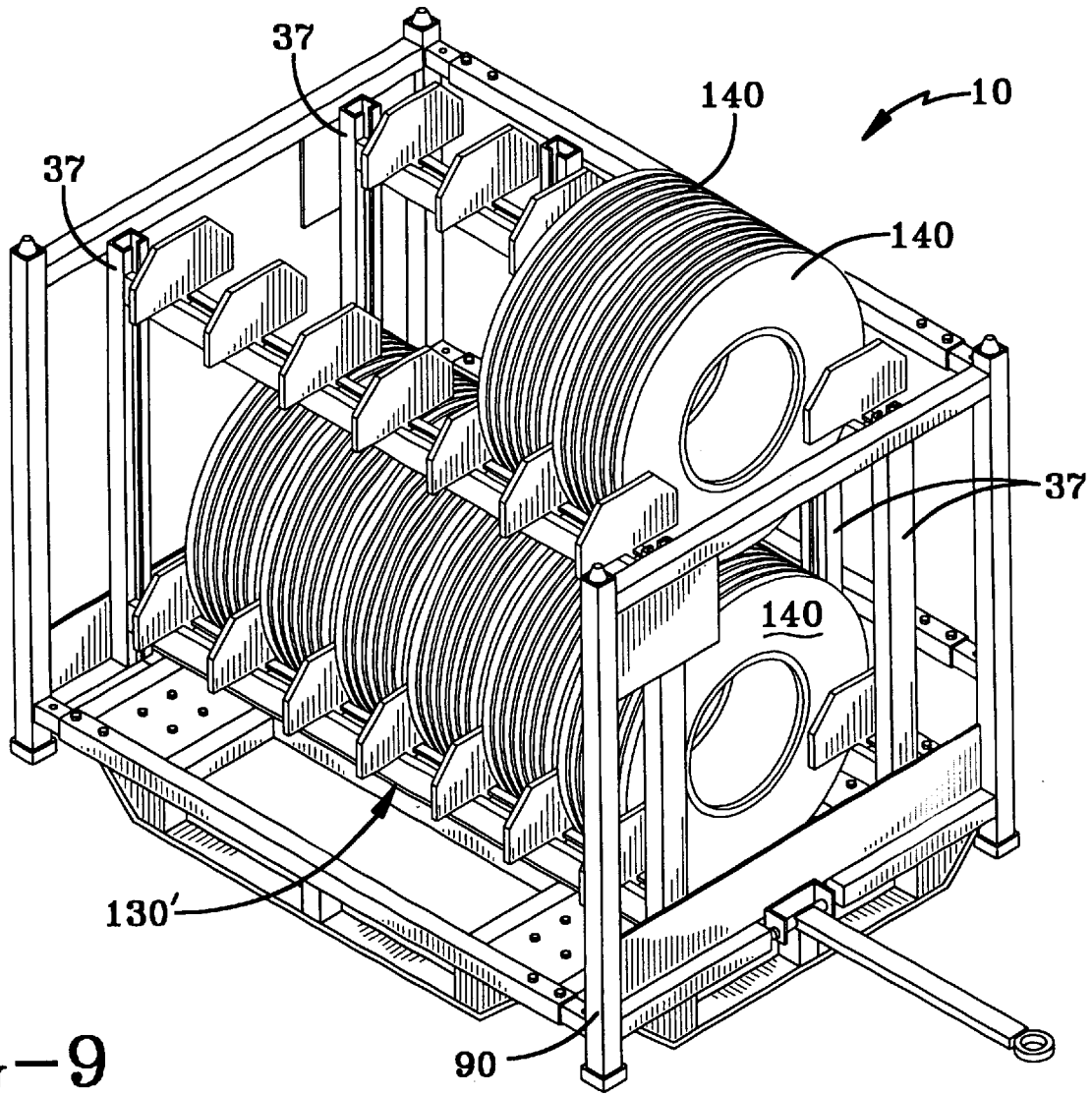
FIG. 9 is an elevated perspective view of the rack of FIG. 1 including dunnage support assemblies and parts for purposes of illustration.
Figure 10:
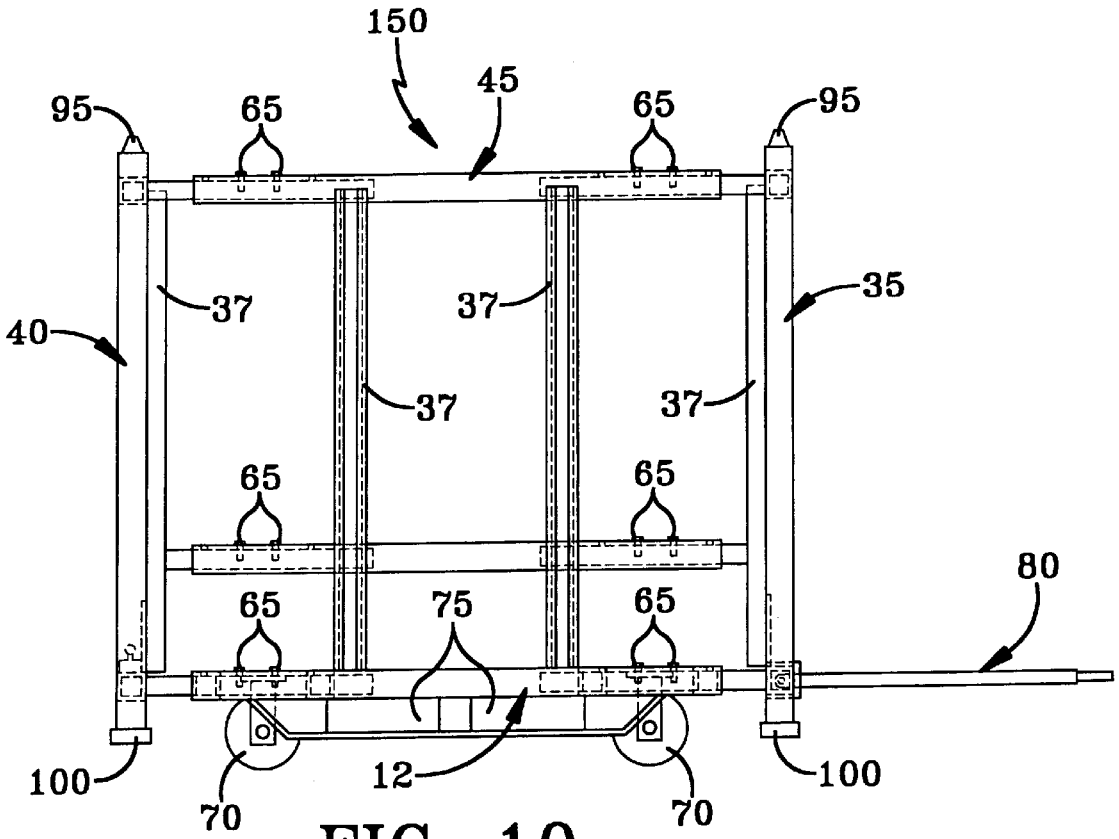
FIG. 10 is a side view of a variation of the rack of FIG. 1.
Figure 11:
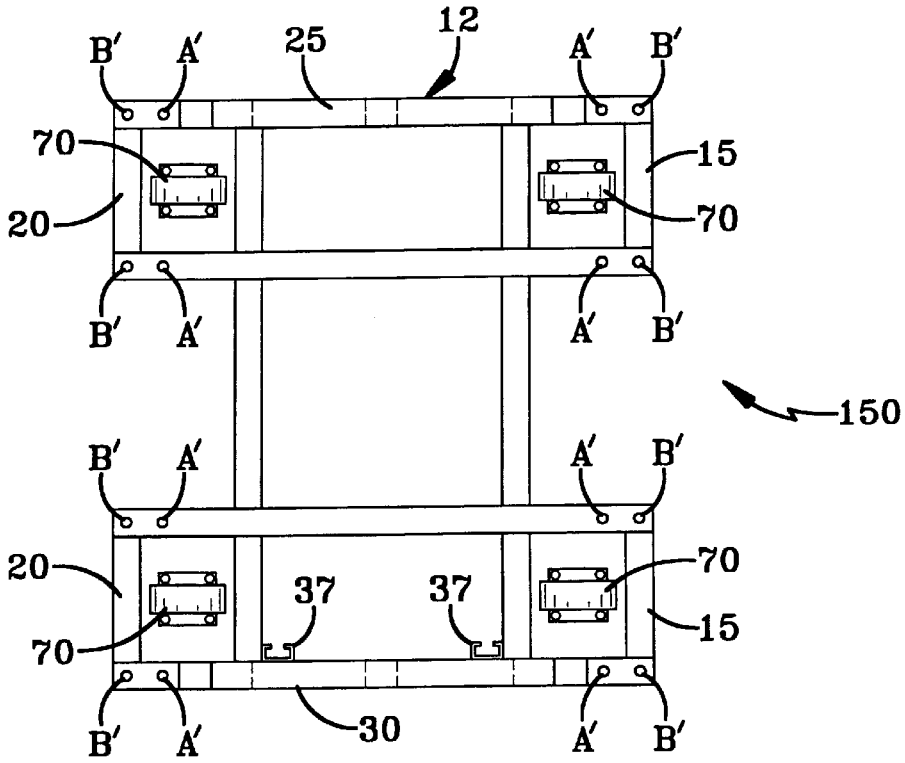
FIG. 11 is a bottom view of the rack of FIG. 10.
Figure 12:
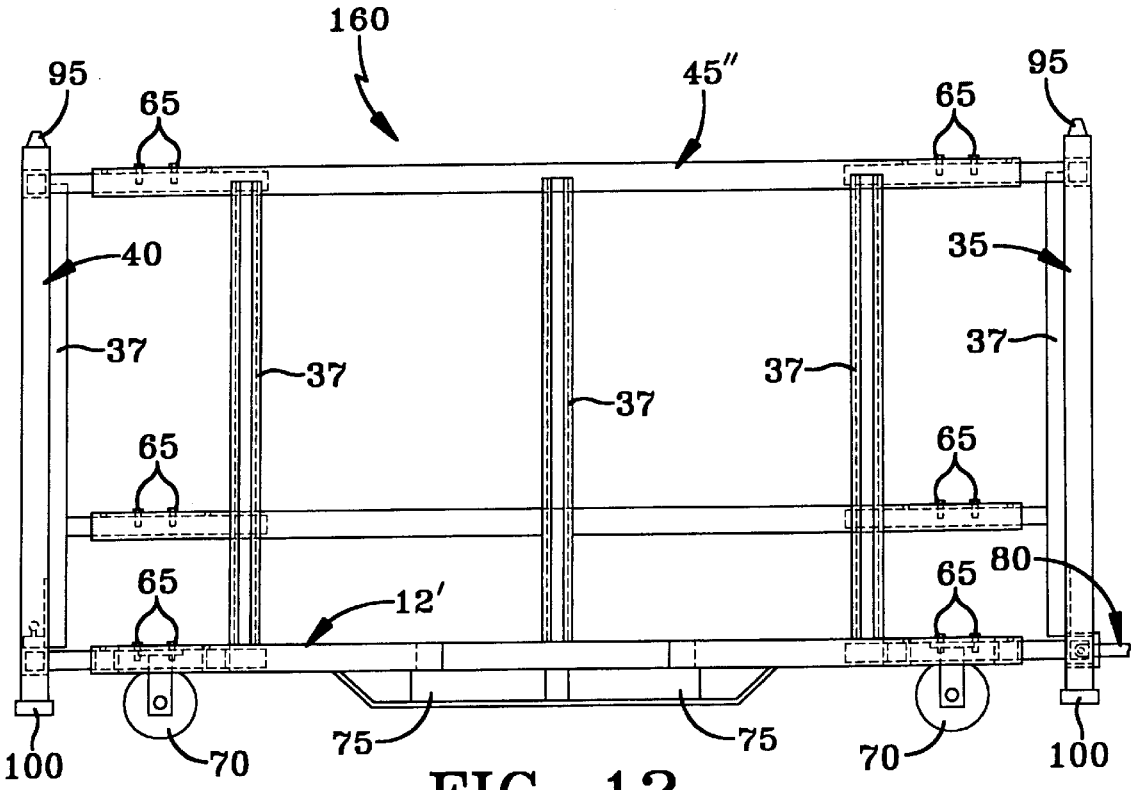
FIG. 12 is a side view, in reduced scale, of an additional embodiment of a dunnage rack embodying the present invention.
Figure 13:
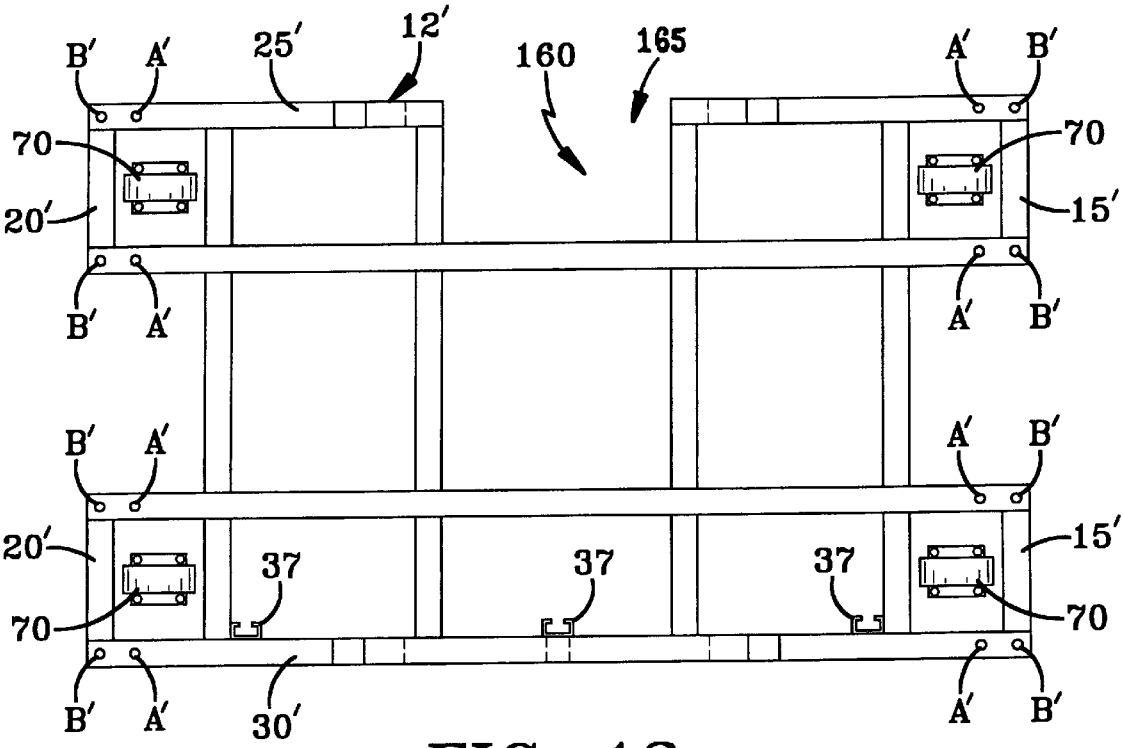
FIG. 13 is a bottom, plan view, in reduced scale, of the rack of FIG. 12.

In operation, the dunnage rack 10 is adjusted to the desired length and height as required by the dunnage dimensions, configuration and desired loading arrangement. Without limiting the scope of the present invention as claimed below, FIG. 9 depicts a plurality of vehicle wheels 140. As this representative configuration, the dunnage rack 10 has been configured with dunnage support hardware 130' installed in the dunnage support assemblies 37. The rack 10 is configured to receive twelve wheels 140, four of which have been removed from the rack 10. Stacking the racks 10, one on top of another, may be precluded when the total height of the rack plus the parts 140 exceeds the typical 51 inch approximate preferred height requirement for double-stacking the racks 10 in a standard common carrier trailer. However, the present invention further contemplates an additional variation, not shown, which includes variable length extensions suitable for receipt on top of stacking pins 95 which would provide the needed clearance above the parts 140 whereby a second rack 10 may be stacked on top of the rack 10 shown in FIG. 9. Special shipment arrangement may be required, however, to accommodate the increased height of the stacked rack configuration. Once the rack 10 of FIG. 9 has been delivered to an assembly line, not shown, and the parts 140 have been removed for installation on a vehicle, the empty rack 10 is either returned to the supplier to be refilled, or reconfigured to carry alternative parts by removal and replacement of the dunnage support hardware 130'.

With reference now to FIGS. 10 through 13, additional embodiments of the present invention are contemplated wherein a modularized system of dunnage racks are employed to accommodate a wide range of part dimensions and configurations without the need for custom designed dunnage racks for each type of part. For example, a dunnage rack 150, as in FIG. 10, may be fabricated and employed, as previously described above, having a module of standard front and rear walls 35 and 40, utilizing a base 12 of a constant width and a selected, standard length as previously explained in more detail above. Although shown incorporating walls 35, 40, 45, rack 150 is compatible for use with walls 35', 40', and 45' as depicted in FIG. 3. A dunnage rack 160, as in FIG. 12, may incorporate a longer base 12' for transport of larger part loads. As with previous racks, rack 160 is also compatible for use with walls of the type previously described.

For use with such standard, modularized walls, a plurality of modularized, interchangeable bases similar to bases 12 and 12' having predetermined lengths suitable to accommodate the majority of part dimensions and configurations would preferably include bases having, for example, selected, standard longitudinal lengths of approximately 44, 56, 68 and 80 inches. As can be readily understood from the figures, variations of longer bases such as base 12' may also incorporate a base such as base 12' with an optional step-in 165. The step-in is preferably approximately twelve inches deep in a lateral direction and approximately twenty inches wide in a longitudinal direction. Additionally, other intermediate length bases may be included in the system so that a plurality of bases, each having a certain length, may be fabricated which are all compatible for use with the standard front, rear, and side support walls 35, 35', 40, 40', 45, 45', and 45", respectively. A plurality of side support walls similar to walls 45, 45', 45" is also fabricated to correspond with each length base in the plurality of bases. Combined with an arrangement of adjustment bores and fastening assemblies, an considerable number of possible dunnage rack lengths and heights may be achieved with only a few base lengths and wall width and height configurations.

From the foregoing, it will be appreciated that the present invention provides a simple apparatus and system for reducing or eliminating avoidable costs, unnecessary material waste and inordinately long lead times associated with the design, development and fabrication of the dunnage racks previously known to the art. The apparatus of the present invention is simple to use, inexpensive to manufacture, and appeals to a large cross section of potential suppliers and manufacturers, especially those which annually introduce markedly different vehicle models which would otherwise require fabrication of custom dunnage racks every year.

The present invention therefore fulfills a real but heretofore unmet need for inexpensive yet adjustable, durable and reusable dunnage racks. While particular preferred embodiments of the invention have been illustrated and described, various modifications can be made without departing from the spirit and scope of the invention, and all such modifications and equivalents are intended to be covered and claimed.

What is claimed is:

1. A freestanding adjustable rack for securely transporting components, comprising:

a base having a substantially planar top surface, and at least two opposite sides;

a pair of walls in slidably adjustable communication with opposite sides of said base, each of said walls having at least one vertical end member and at least one projection for extending into a corresponding portion of said base;

at least one substantially hollow, longitudinally slotted member affixed to at least one of said walls at a location interior to said at least one vertical end member and adapted for detachable connection to at least one component holding apparatus; and at least one securing device for releasably affixing the position of each of said walls with respect to said base;

wherein upon the slidably adjustment of one or both walls of said pair of walls, said substantially planar top surface of said base is maintained to the new position of said walls.

2. The adjustable rack of claim 1, further comprising a transportation assembly mounted to an underside of said base.

3. The adjustable rack of claim 2, wherein said transportation assembly includes a plurality of spaced apart wheels.

4. The adjustable rack of claim 2, wherein said transportation assembly includes at least one pair of spaced apart receptacles for receiving the forks of a forklift.

5. The adjustable rack of claim 1, further comprising a side wall disposed along an edge of said base and extending between said pair of walls.

6. The adjustable rack of claim 5, wherein said side wall is of substantially the same height as said pair of walls.

7. The adjustable rack of claim 1, further comprising a plurality of horizontal projections extending from each wall toward said base.

8. The adjustable rack of claim 7, wherein certain of said projections are received by a corresponding structure on said base.

9. The adjustable rack of claim 7, wherein certain of said projections are received by a corresponding structure on a side wall.

10. The adjustable rack of claim 7, further comprising at least one aperture located in said projections for receiving said at least one securing device.

11. The adjustable rack of claim 1, further comprising a plurality of spaced apart vertical posts located on each wall.

12. The adjustable rack of claim 11, wherein said posts have a lower section and an upper section, said lower section and said upper section operable in a telescoping relationship such that the height of said walls may be adjusted.

13. The adjustable rack of claim 11, further comprising a stacking pin at an upper extremity and a stacking receptacle at a lower extremity of said vertical posts.

* * * * *